United States Patent [19]

True

[11] Patent Number: 4,745,324

[45] Date of Patent: May 17, 1988

[54] HIGH POWER SWITCH TUBE WITH FARADAY CAGE CAVITY ANODE

[75] Inventor: Richard B. True, Santa Clara, Calif.

[73] Assignee: Litton Systems, Inc., Woodland Hills, Calif.

[21] Appl. No.: 862,122

[22] Filed: May 12, 1986

[51] Int. Cl.[4] ..... H01J 29/48; H01J 1/46; H01J 29/46

[52] U.S. Cl. ..... 313/296; 315/14; 315/3.5; 315/3.6; 313/293; 313/297; 313/298; 313/299; 313/300; 313/302; 313/303; 313/304; 313/349

[58] Field of Search ..... 313/293, 294, 296, 297, 313/299, 300, 302, 303, 304, 449, 348, 457, 460, 349, 454, 452, 448; 315/31 R, 14, 3.5, 3.6

[56] References Cited

U.S. PATENT DOCUMENTS

| | | | |
|---|---|---|---|
| 2,946,915 | 7/1960 | Haase | 313/296 |
| 3,046,422 | 7/1962 | Cook | 313/297 |
| 3,140,419 | 7/1964 | Van der Poel | 313/296 |
| 3,571,651 | 3/1971 | Wilbur | 315/3.5 |
| 3,594,605 | 7/1971 | Blinn | 315/3.5 |
| 3,609,439 | 9/1971 | Singer | 313/293 |
| 3,859,552 | 1/1975 | Hechtel | 313/449 |
| 3,886,399 | 5/1975 | Symons | 315/3.5 |
| 3,903,450 | 9/1975 | Forbess et al. | 313/452 |
| 3,934,168 | 1/1976 | Hardman et al. | 313/296 |
| 3,995,193 | 11/1976 | Horigome et al. | 315/3.5 |
| 4,023,061 | 5/1977 | Berwick et al. | 313/349 |
| 4,553,064 | 11/1985 | Amboss | 313/349 |
| 4,593,230 | 6/1986 | True | 313/349 |

OTHER PUBLICATIONS

Hechtel et al, "A Dual Electron Gun Having Non-Intercepting Grids," Conference 1973 *Inter. Electron Device Meeting Tech. Dig.*, Dec. '73, pp. 171–174.

*Primary Examiner*—David K. Moore
*Assistant Examiner*—Michael J. Nickerson
*Attorney, Agent, or Firm*—Poms, Smith, Lande & Rose

[57] ABSTRACT

A high-power switch tube is shown constructed from a plurality of electron guns each gun having a cathode and an anode. Between the cathode and anode is mounted a shadow grid closest to the cathode beyond which is mounted a control grid, a screen grid, and, in some applications, by a suppressor grid. Each anode is formed with an anode cavity having an opening that is smaller in dimension than the largest dimension of the cavity thus forming a Faraday cage collector which prevents secondary emission problems.

18 Claims, 5 Drawing Sheets

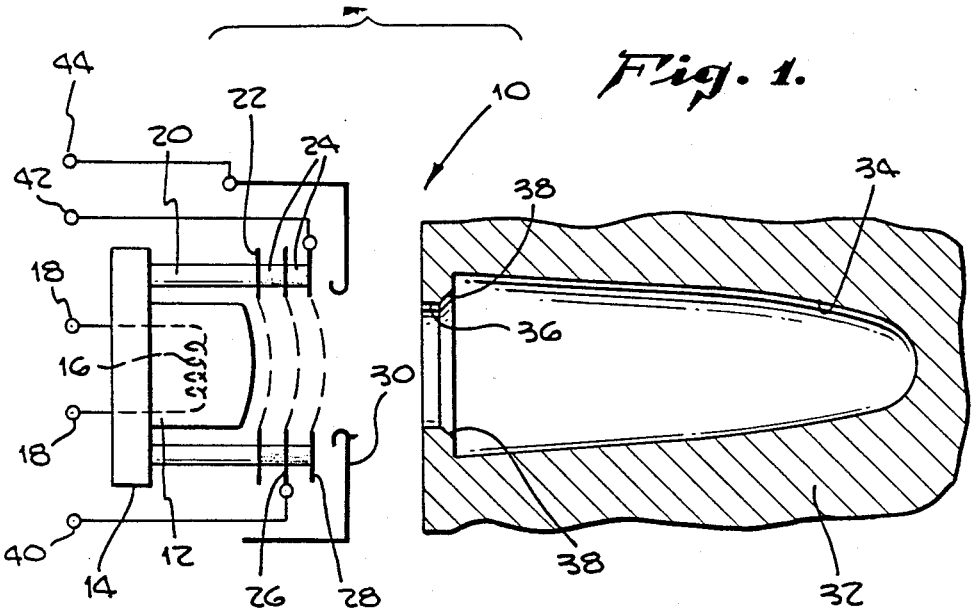
Fig. 1.
Fig. 3.
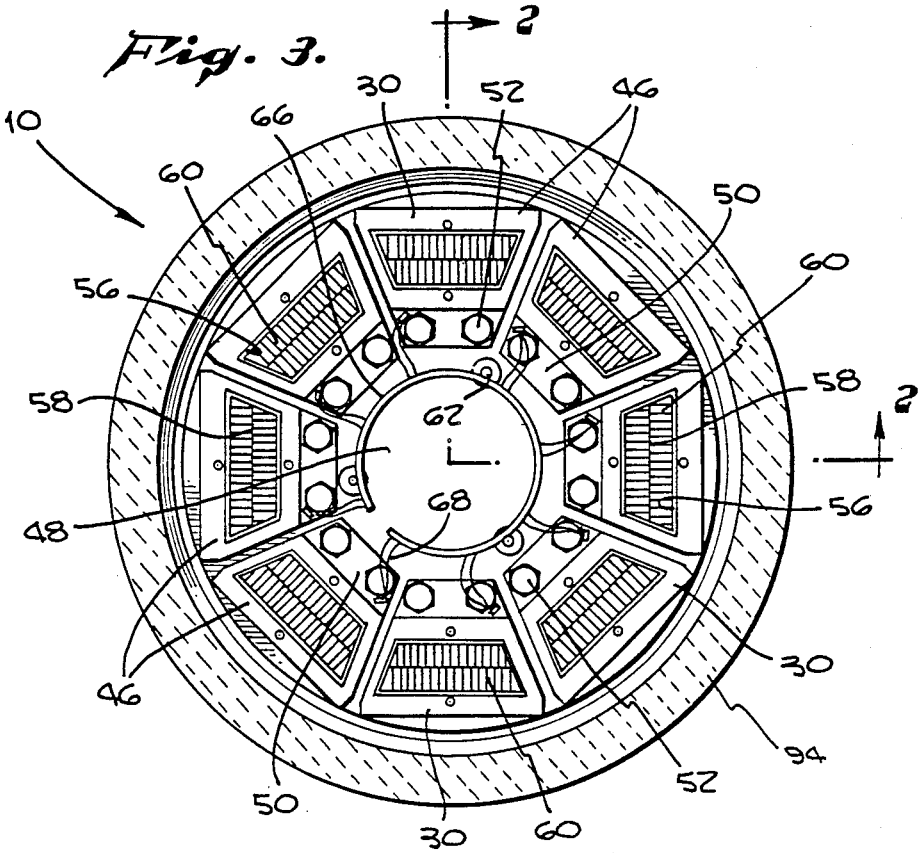

HIGH POWER SWITCH TUBE WITH FARADAY CAGE CAVITY ANODE

BACKGROUND OF THE INVENTION

The present invention relates to a high-power switch tube and, more particularly, to a specially designed power switch utilizing a double-walled Faraday cage collector as an anode.

DESCRIPTION OF THE PRIOR ART

Electron tubes having a cathode, a plurality of grids, and an anode are well known. Their uses include microwave devices, radar devices and high-power switches. However, electron tubes used for high-power switches have had a tendency toward being expensive, unreliable, and incapable of providing high levels of current simultaneous with modest voltages between cathode and anode.

SUMMARY OF THE INVENTION

Accordingly, an object of the present invention is to provide a high-power switch which is capable of rapidly switching both high voltages and high currents.

Another object of the present invention is to provide a switch to turn on and off a relatively high voltage signal (kilovolts) utilizing a relatively low voltage control signal (volts).

Still another object of the invention is to provide a high-reliability cathode with light loading and reduced temperature for long life and low power requirements.

A further object is to provide a high-power switch tube in which the cathode may be easily removed for repair and in which the cathode-anode design may be used redundantly for fail-soft performance.

A still further object of the present invention is to provide a large beam collector area within the anode which reduces thermal stress and prevents secondary emission.

In accomplishing these and other objects, there is provided a heated cathode adjacent to which is mounted a shadow grid which is retained at cathode potential. Beyond the shadow grid towards the anode is a control grid at positive or negative potential with respect to cathode, a screen grid having a positive potential with respect to cathode, and a suppressor grid held at cathode potential. The suppressor grid screens the shadow grid, control grid, and screen grid from the anode to a) protect the screen, control, and shadow grids from arc damage and b) to decrease the capacitance and provide faster switching. The anode is designed to include a double-walled Faraday cage collector which increases the area for beam collection over a standard beam power tetrode anode by more than a factor of two.

BRIEF DESCRIPTION OF THE DRAWINGS

A better understanding of the present invention and of other objects and advantages will become apparent after consideration of the following detailed description and the accompanying drawings, wherein:

FIG. 1 is a schematic representation showing the high-power switch of the present invention including the cathode, grids, and anode;

FIG. 3 is an end view of the high-power switch taken along line 3—3 of FIG. 2 showing eight cathode gunlets in the cathode assembly;

FIG. 4 is a computer simulation showing the electron trajectories of the high-power switch when the switch is on.

DESCRIPTION OF THE PREFERRED EMBODIMENTS

Figure 2:
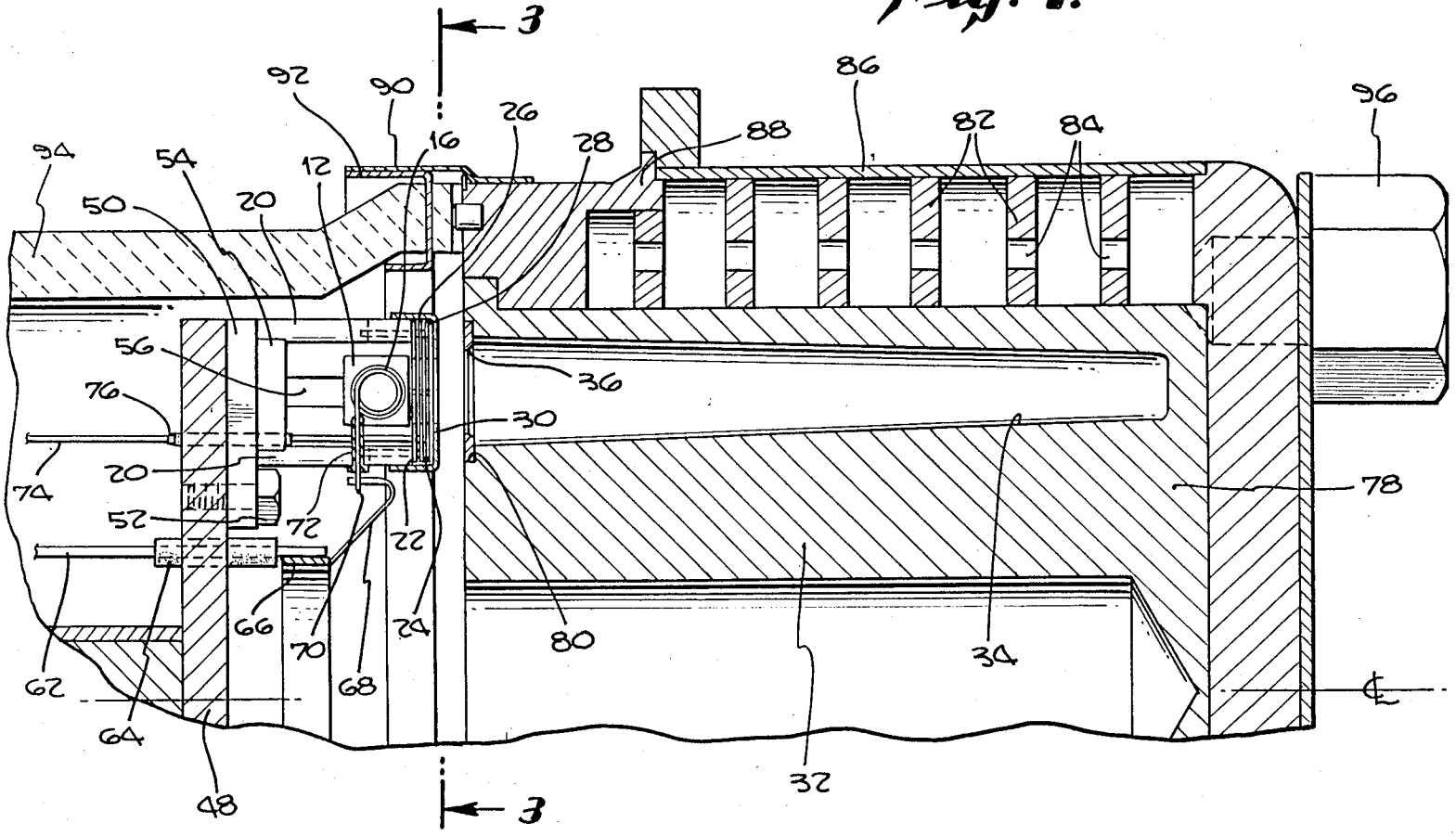
FIG. 2 is a cross-sectional view taken along line 2—2 of FIG. 3 showing the arrangement of FIG. 1 in greater detail including a liquid cooled anode.

A high-power switch 10 is shown schematically in FIG. 1 having a dispenser cathode 12 mounted upon a plate 14 that is heated by a helically wound coil 16 which receives its electrical energy via terminals 18. Mounted upon the plate 14, as by conductive posts 20, is a shadow grid 22 which is maintained at the same electrical potential as cathode 12 via the posts 20 and plate 14. Mounted in alignment with, and beyond, the shadow grid 22, as by insulated posts 24, is a control grid 26 which is aligned with the shadow grid 22. A second set of posts 24 mounts a screen grid 28 in alignment with grids 22 and 26 to form a grid stack. Beyond the grid stack of shadow grid 22, control grid 26, and screen grid 28 is a suppressor grid 30 which screens the grids from an anode 32. In the preferred embodiment, the suppressor grid 30 does not extend completely across the face of cathode 12. The anode 32 includes a double-walled Faraday cage collector 34 having an inner dimension that is greater than its electron receiving opening 36 formed by shoulders 38.

It will be understood that the cathode 12 may be slightly dished (either concave or convex) and that the grids 22, 26, and 28 may also be dished so as to be coaxially or concentrically arranged with one another and the cathode. The reason for this is that operation of the high-power switch 10 tends to heat the grids causing them to thermally expand. By dishing the grids, the expansion is controlled in a particular direction. If the grids were designed as flat surfaces, thermal expansion could cause them to bow in one direction or another thus creating a design problem. However, the present invention should not be limited by the existence of a flat or dished grid system.

As seen in FIG. 1, power terminals 40, 42 and 44 are utilized to provide power to the control grid 26, screen grid 28, and suppressor grid 30, respectively. The shadow grid and suppressor grid 30 are each maintained at cathode potential within the preferred embodiment, however.

Referring now to FIGS. 2 and 3, the preferred embodiment of the high-power switch tube 10 is shown in greater detail. A single high-power switch tube 10 may be utilized (as shown in FIG. 1). In the preferred embodiment, however, the electron gun is divided into eight gunlets 46 mounted about the periphery of a central, conductive mounting plate 48. This arrangement creates an easily repaired cathode assembly and a fail-soft system in that failure of one cathode gunlet 46 will not cause the tube 10 to fail.

Note that FIG. 3 is an end view of the cathode subassembly including eight cathode gunlets 46 taken along line 3—3 of FIG. 2. However, FIG. 2 shows only one gunlet 46 as if that Figure were taken along line 2—2 of FIG. 3. FIG. 2 also shows the liquid cooled anode 32, not shown in FIG. 3.

The mounting plate 48 mounts individual gunlet plates 50, as by bolts 52 (FIG. 3). Attached to plate 50, as by spot welding, is a cathode plate 54 which mounts posts 56 to support the cathode 12 (FIG. 2). Conductive posts 20 are attached to plate 50, as by welding, and support the screen grid 22. Insulating posts 24 support the control grid 26 and the screen grid 28 in a manner similar to that described with regard to FIG. 1 above. The suppressor grid 30 is a cup shaped and fits over the posts 20 for retention in the position shown. A review of FIG. 2 will now make it clear that the plate 48, plates 50 and 54, and posts 20 are all retained at the cathode potential. Thus, the shadow grid 22 and suppressor grid 30 are also retained at cathode potential.

The grids 22, 26, 28 and 30 are all made from 0.004 to 0.005 inch thick moly. As seen in FIG. 3, the grids all have a common configuration. That is, each grid has a trapezoidally-shaped opening 56. Grids 22, 26, and 28 have a central support element 58 traversing the middle of the opening along the longest axis while grid 30 has an opening free of grid elements. Extending from the sides of the opening 56 in grids 22, 26 and 28 to the central support are a plurality of grid elements 60 which complete the grid structure. The grid elements 60 are typically 0.004 to 0.005 inches square. Note that the trapezoidally shaped of opening of the suppressor grid 30 permits the grid elements 60 of grid 28 to show. in FIG. 3.

Referring to FIG. 2, a conductor, such as a copper wire 62, connects from terminal 18 (FIG. 1) for providing power to the cathode heating coil 16. The conductor 62 passes through an insulating busing 64 in plate 48 and terminates adjacent the cathode gunlet sub-assembly 46. Three conductors 62 are used in the preferred embodiment, see FIG. 3. A ring-shaped conductor 66 is spot welded to conductors 62 for providing power to each of the eight cathode heater coils 16 via a conductive ribbon 68 spot welded to the conductor 66 and, at its opposite end, to each lead 70 from the heating coils 16. Leads 70 pass through an insulated busing 72 to isolate them from the conductive posts 20. In a similar manner, power is provided to the control grid 26 and screen grid 28 by conductors 74 (only one of which is shown in FIG. 2) which pass through insulators 76 and extend between the cathode 12 and posts 20. Conductor 74, as shown, passes through shadow grid 22 to make electrical connection with the control grid 24. In a similar manner, a second conductor 74, not shown, makes electrical connection with the screen grid 26 after it passes through the shadow grid 22 and control grid 26.

As seen in FIG. 2, each of the eight anodes 32 are formed in a single cylindrical block of copper 78 wherein each Faraday cage collector cavity 34 is coined into the block for low-cost construction. The anode openings 36 are formed by a plurality of trapezoidally shaped rings 79 of moly or copper which are press fitted into grooves 80 formed at the surface opening of each cavity 34.

Surrounding the outer periphery of the copper block 78 are a plurality of cooling rings 82 having aperatures 84 therein. The cooling rings are closed by a cylindrical tube 86 which may be press fitted into a collar 88 that fits about the outer periphery of block 78 and is aligned in parallel with the anode surface that contains the anode cavity openings 36. Collar 88 mounts an annular ring 90 which may be attached thereto by welding and which slides over a second annular ring 92 attached to the outer surface of an insulated housing 94 which surrounds the cathode gunlets 46. The assembly of the high-power switch 10 is completed by spot welding, for example, the ring 90 to the ring 92.

Anode block 78, rings 82, and tube 86 form cooling channels which are supplied with a suitable coolant, such as water, through a hose fitting 96. In the embodiment shown, the center of copper block 78 is hollowed, as by drilling, to reduce weight and promote cooling.

The operation of the high-power switch 10 in its conductive state will be described with reference to FIG. 4 wherein the electron trajectories are shown as generally horizontal lines, while equipotential contours are shown as generally vertical lines in a computer simulated plot. The eight individual gunlets 46 are connected to an electrical potential which, for example, places a zero voltage upon cathode 12. As stated above, the shadow grid 22 is also retained at zero volts while the control grid 26 is maintained at plus 400 volts. In operation, the screen grid 28 is maintained at plus 1,250 volts, while the suppressor grid 30 is maintained at zero volts, i.e., cathode potential. The anode 32 is maintained at plus 2,000 volts. When the high-power switch 10 is conducting, the current carrying capacity may be between 25 to 28 amps.

Figure 5:
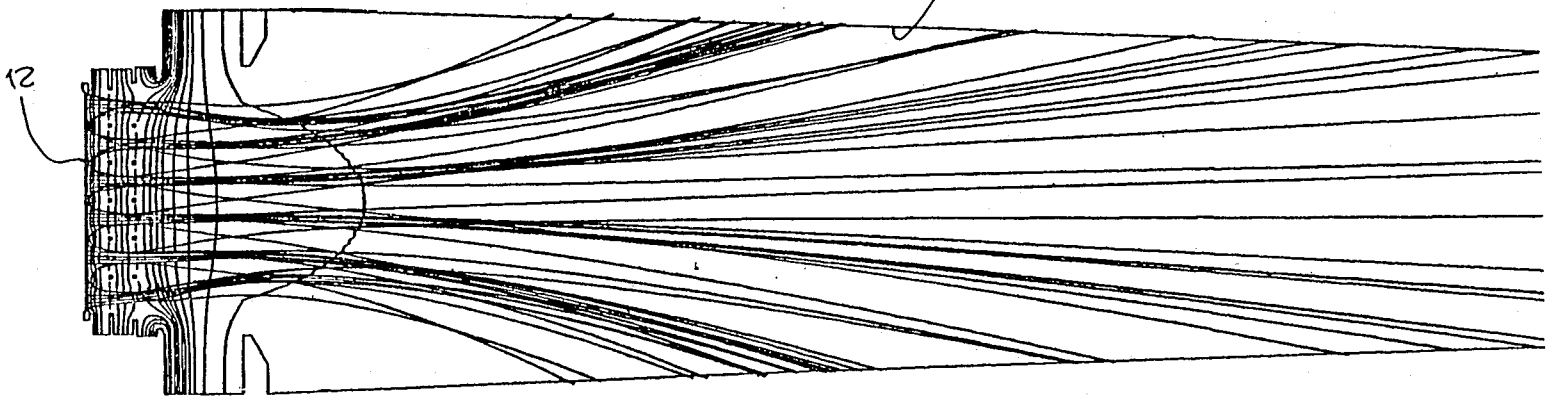
FIG. 5 is a computer simulation that shows the electrons from FIG. 4 impinging upon the surfaces of the Faraday cage collector that forms the anode.

As seen in FIG. 5, the flow of electrons from cathode 12 toward anode 32 is spread over a significantly increased surface area which is greater than twice that known in the prior art. This increased area facilitates heat transfer to the liquid coolant which lowers the internal surface temperature of the collector which, in turn, extends tube life. The Faraday cage collector 34 also acts to prevent secondary emission of electrons from the cage 34.

Figure 4:
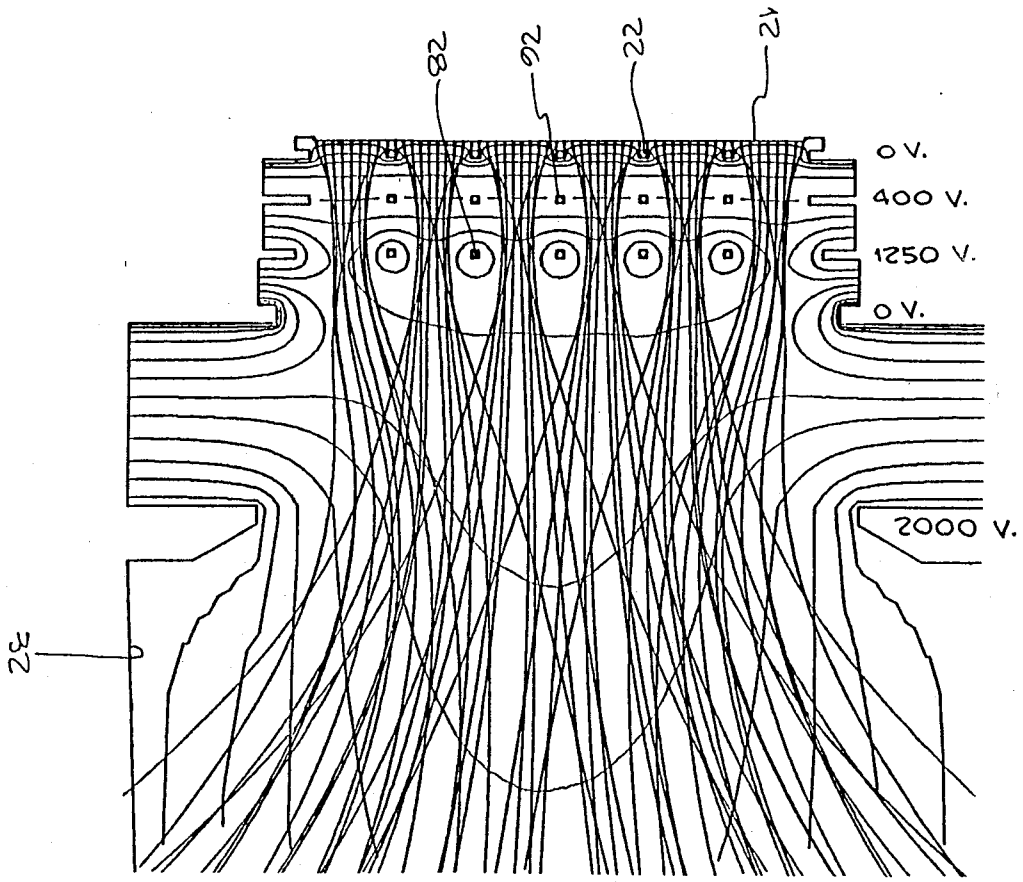
Figure 6:
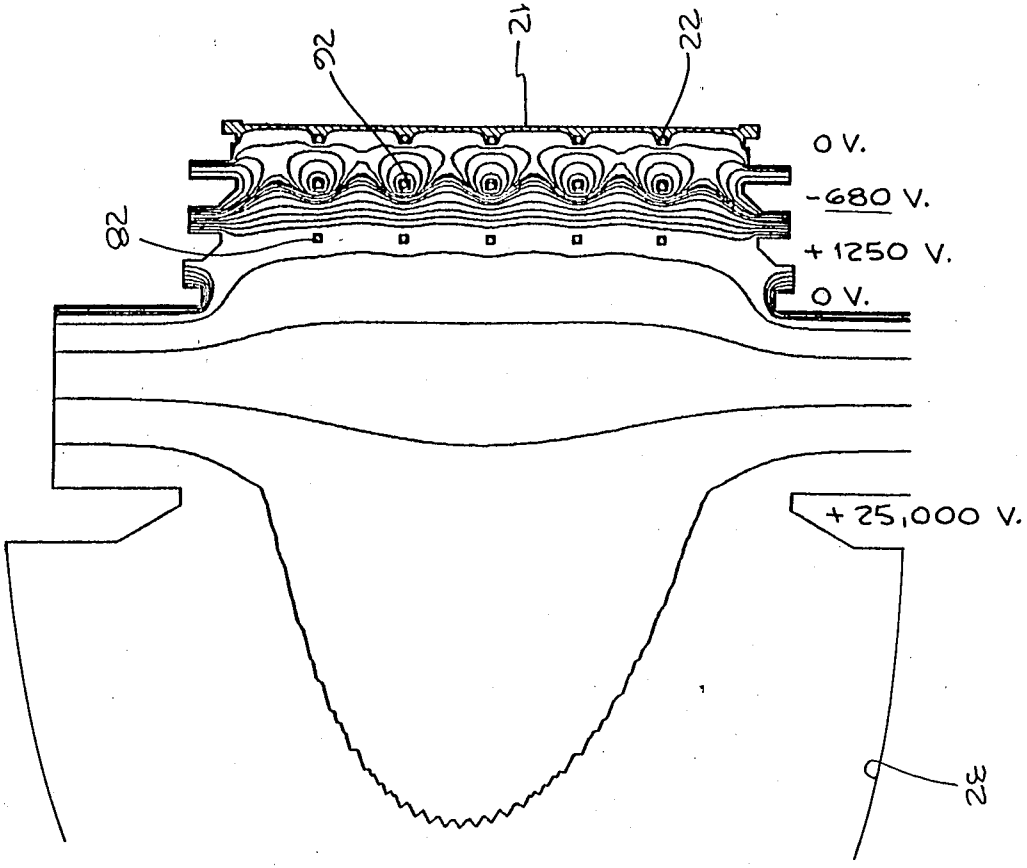
FIG. 6 is a computer simulation similar to FIG. 4 showing the control grid with a negative signal for cutoff.

Referring now to FIG. 6, a drawing similar to FIG. 4 is shown wherein the high-power switch tube 10 is shown in a cutoff mode with the potentials on the cathode 12 and shadow grid 22 the same as when the tube 10 is on. The potential on control grid 26 is dropped from plus 400 volts to minus 680 volts, while the potentials on the screen grid 28 and the suppressor grid 30 remain the same. In this configuration, there is no current flowing through the switch 10 and the voltage on the anode 32 increases to plus 25,000 volts. While all of the voltages have been expressed with respect to the cathode which is at ground potential, it will be understood that the high-power switch tube 10 can be operated with the anode at ground potential and the cathode at a negative voltage. The high-power switch 10 can thus cut off 25 KV.

In the embodiment shown, the grids have the following functions. The shadow grid 22 prevents the heating of the control grid 26 and screen grid 28. The control grid 26 functions to turn on or off the beam current with a voltage change of only 1,080 volts. The screen grid 28 retains the 25 amp current uniformly across the face of the cathode 12 during the operating of tube 10. Finally, the suppressor grid 30 aids in arc protection and reduces the Miller effect. That is, the suppressor grid 30 serves to reduce the capacitance between the elements and speeds the switching time of switch 10. Suppressor grid 30 also screens the remaining grids from the anode and any secondary emission therefrom. from. The anode is designed with a Faraday cage collector to further reduce secondary emission and to increase the surface area of the cavity for receipt of electrons.

Figure 7:
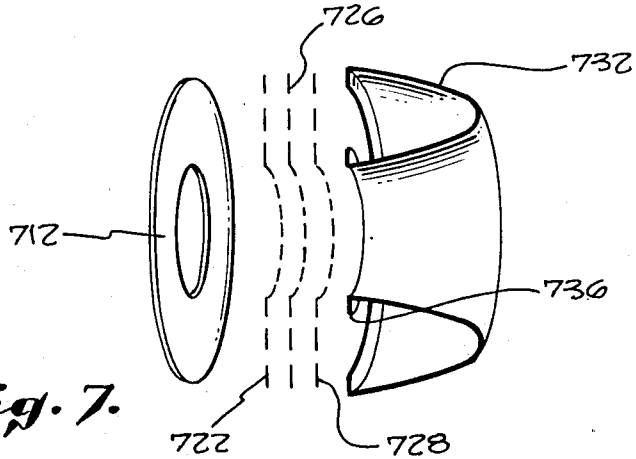
FIG. 7 is a schematic diagram similar to FIG. 1 showing another embodiment of the present invention.

While the present invention has been described as utilizing eight gunlets 46 about an annular ring 48, it will be understood that other cathode and anode configurations are possible within the teachings of the present invention. For example, FIG. 7 shows a substantially flat cathode 712 having an annular surface with an inner and outer diameter and a set of substantially flat grids including a shadow grid 722, control grid 726, and screen grid 728 disposed between the cathode 712 and the anode 732. The anode 732 is shaped as a large annular groove having an opening 736 that is smaller than the width of the groove which forms the anode 732.

Figure 8:
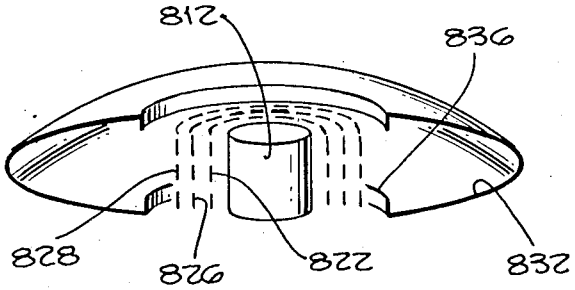
FIG. 8 is a schematic diagram similar to FIG. 1 showing yet another embodiment of the present invention.

Another variation of the present invention is shown in FIG. 8 where a cylindrically-shaped cathode 812 has an electron emitting surface on its outer diameter and is surrounded by a shadow grid 822, a control grid 826, and a screen grid 828. A toroidally-shaped anode 832 surrounds the grids and is provided with an inner diameter whose surface has a ring-shaped opening at 836 to receive the electrons emitted from cathode 812 into the Faraday cage collector that forms anode 832.

In addition to the variations shown in FIGS. 1, 7, and 8, other variations are possible within the teachings of the present invention which should be only limited by the appended claims.

I claim:

1. A high-power switch, comprising: a plurality of individual gunlets, each gunlet comprised of:

a cathode;

a shadow grid mounted adjacent said cathode;

a control grid mounted beyond said shadow grid; and a screen grid mounted beyond said control grid;

a plurality of anode cavities mounted in closely spaced proximity to said screen grids of said plurality of gunlets, said plurality of anode cavities facing said screen grids of said cathode gunlets having openings therein that are smaller in dimension than a corresponding initial internal dimension that defines said cavities to form a plurality of Faraday cage collectors having an increased surface area for increasing the electrical power switched by said high-power switch and creating a fail soft switch should one or more of said cathode gunlets fail.

2. A high-power switch, as claimed in claim 1, additionally comprising:

each gunlet having a suppressor electrode mounted between said screen grid and said anode.

3. A high-power switch, as claimed in claim 1, additionally comprising:

means for placing a positive and negative potential upon said control grid to change the conductive state of said high-power switch.

4. A high-power switch, as claimed in claim 1, wherein:

said plurality of cathode gunlets are mounted on a flat, annular surface; and said plurality of Faraday cage collectors that form said plurality of anodes are mounted on a flat, annular surface each opposite one of said plurality of cathodes.

5. A high-power switch, as claimed in claim 1, additionally comprising:

individual cathode plates each mounted upon said flat, annular surface for mounting said cathode and said shadow, control, and screen grids in individual gunlet assemblies.

6. A high-power switch, as claimed in claim 4, wherein:

said plurality of cathode gunlets each occupy a 45 degree section of said annular surface.

7. A high-power switch, as claimed in claim 1, wherein:

each cathode gunlet and associated set of grids have non-axisymmetric openings with grid elements traversing said opening; and each anode cavity has a non-axisymmetric opening.

8. A high-power switch, as claimed in claim 7, wherein:

said non-axisymmetric openings of said cathode gunlets and said anodes are trapezoidally shaped openings.

9. In a high-power switch tube having a cathode, an anode, and a plurality of grids mounted therebetween, the improvement comprising:

said anode formed as a non-axisymmetrical electron receiving cavity having a non-axisymmetrical electron opening therein that is smaller in dimension than a corresponding initial internal dimension that defines said cavity to form a non-axisymmetrical Faraday cage collector cavity having an increased surface area for increased electron reception.

10. A high-power switch tube, as claimed in claim 9, additionally comprising:

said anode, including a plurality of Faraday cage collector cavities arranged in a ring-like pattern; and said cathode including a plurality of individual cathode subassemblies each mounting its own set of said plurality of grids and each arranged in a ring-like pattern facing said anode cavities in close juxtaposition thereto.

11. A high-power switch tube, as claimed in claim 10, additionally compromising:

each set of grids having a trapezoidally shaped opening with grid elements traversing said opening.

12. A high-power switch tube, as claimed in claim 10, wherein each set of said plurality of grids includes shadow grid, a control grid, and a screen grid.

13. A high-power switch tube, as claimed in claim 12, wherein each set of said plurality of grids further includes a suppressor grid.

14. A high-power switch tube, as claimed in claim 12, additionally comprising:

means for applying a voltage change of approximately 1 KV to said control grid to change said tube from an on to an off condition.

15. A high-power switch tube, as claimed in claim 9, additionally comprising:

means for liquid cooling said anode.

16. A high-power switch tube, as claimed in claim 10, additionally comprising:

said plurality of individual cathode subassemblies each mounted on an individual mounting plate, and a singular plate for mounting said individual mounting plates in said ring-like pattern.

17. A high-power switch having an axis of symmetry, comprising:

a plurality of individual cathode gunlets each including a set of screens associated therewith;

each gunlet axisymmetrically mounted about said axis;

a plurality of anode cavities mounted in juxtaposition to said cathode gunlets axisymmetrically about said axis;

each said cathode gunlet and each said anode cavity having a non-axisymmetrically shaped opening facing one another; and each said non-axisymmetric anode cavity opening having an initial opening that is small in dimension than a corresponding initial internal dimension that defines said anode cavity just behind its opening to form a non-symmetrical cavity having an increased surface area for increased electron reception.

18. A high-power switch, as claimed in claim 17, wherein said non-symmetrically shaped opening of said cathode gunlets and said anodes are trapezoidally shaped openings.

* * * * *